United States Patent [19]

Mattress, Jr.

[11] 4,226,102

[45] Oct. 7, 1980

[54] METER LOCK

[75] Inventor: Albert Mattress, Jr., Spencer, Mass.

[73] Assignee: Norman S. Blodgett, Worcester, Mass. ; a part interest

[21] Appl. No.: 68,586

[22] Filed: Aug. 22, 1979

Related U.S. Application Data

[63] Continuation of Ser. No. 908,972, May 24, 1978, abandoned, which is a continuation of Ser. No. 771,757, Feb. 24, 1977, abandoned.

[51] Int. Cl.[3] ..... B65D 55/14

[52] U.S. Cl. ..... 70/164; 220/324; 292/256.6; 361/369

[58] Field of Search ..... 70/42, 43, 163, 164, 70/165, 166, 344; 292/256, 258, 256.6, 307 B, 256.63; 24/20 R, 21, 25, 230 AL, 211 R; 220/324; 361/364, 369

[56] References Cited

U.S. PATENT DOCUMENTS

| | | | |
|---|---|---|---|
| 1,005,852 | 10/1911 | Lewis | 70/43 |
| 1,419,469 | 6/1922 | Paschke | 24/230 AL X |
| 1,467,254 | 9/1923 | Tarbet | 292/256.6 X |
| 1,824,199 | 9/1931 | Donohoe | 24/20 R |
| 2,029,173 | 1/1936 | Jesser | 292/256.6 |
| 2,776,159 | 1/1957 | Cookson | 292/256.6 |
| 3,311,957 | 4/1967 | Dunn | 24/21 |
| 3,440,330 | 4/1969 | Sloop | 361/369 X |
| 3,861,180 | 1/1975 | Heckroite et al. | 70/164 |
| 3,867,822 | 2/1975 | Morse et al. | 70/164 |
| 3,968,985 | 7/1976 | Nielsen et al. | 292/340 |
| 3,969,795 | 7/1976 | Stephenson | 24/230 AL |
| 3,996,501 | 12/1976 | Tracey | 220/324 X |
| 4,008,585 | 2/1977 | Lundberg | 70/164 |
| 4,049,313 | 9/1977 | Lundberg | 292/307 R |
| 4,058,992 | 11/1977 | Nielsen | 70/34 |
| 4,080,811 | 3/1978 | Nielsen | 70/164 |

FOREIGN PATENT DOCUMENTS

| | | | |
|---|---|---|---|
| 724237 | 8/1942 | Fed. Rep. of Germany | 70/236 |
| 605977 | 8/1948 | United Kingdom | 70/227 |

*Primary Examiner*—Thomas J. Holko

*Attorney, Agent, or Firm*—Norman S. Blodgett; Gerry A. Blodgett

[57] ABSTRACT

Meter lock including a band for embracing and holding together a meter flange and a corresponding flange on a meter box, the lock including a housing for holding and locking together the ends of the band with a disengagement taking place only by removal of a locking pin.

14 Claims, 12 Drawing Figures

METER LOCK

This is a continuation of application Ser. No. 908,972 filed May 24, 1978 which is a continuation of application Ser. No. 771,757 filed Feb. 24, 1977, both now abandoned.

BACKGROUND OF THE INVENTION

It is the usual practice in the installation of an electric meter at the point of use to provide a box into which extend the incoming and out-going electrical cables and to apply to the face of this box the meter for reading the amount of consumption. The box is provided with an annular flange and the meter is provided with a similar flange. The two flanges being held together by a U-shaped band. Originally, the ends of the band were held together by a nut and bolt which allowed the band to be clamped tightly around the flanges and hold the meter firmly in place. In recent years, however, it has been necessary to lock the band in place so that it could not be removed. This was because many unauthorized persons have been entering the meter box and "bypassing" the meter, thus using electricity without it being recorded in the meter. Also, there has been some vandalism in the form of removing the meter and damaging it. Also, an important problem is encountered because of the fact that some customers remove the meter and replace it in inverted condition so that the meter operates in reverse and gives a low reading. In addition, there have been those who actually steal the meter itself for their own purposes. In order to counteract these tendencies, it has been necessary to provide a lock to hold the ends of the band together to prevent removal of the meter from the box. At one time it was only necessary to provide a lock having a seal, so that it would be evident that the lock had been tampered with, but it has been found that a simple seal is often not sufficient to discourage those who wish to gain entry to the meter and the meter box. One of the problems that has been encountered in attempting to design a practical lock for this purpose has been the fact that, if an edge of the band is available and accessible, it is possible to cut the band with a pair of strong tin snips or aircraft shears. Furthermore, while many ingenious locks have been conceived for this purpose, most of them are quite expensive and, because of a complexity of their mechanism, they have been relatively difficult to install or remove by the legitimate meter technician. After all, part of the problem is the fact that, even though the would-be thief is not able to dismantle the lock and the band, nevertheless he can do so much damage to the lock that is difficult for the legitimate electrical installer to later obtain access to the meter. These and other difficulties experienced with the prior art devices have been obviated in a novel manner by the present invention.

It is, therefore, an outstanding object of the invention to provide a meter lock which is difficult for an unauthorized person to dismantle for access to the meter and relatively easy to install or remove by an authorized person.

Another object of this invention is the provision of a meter lock which is simply in construction and which can withstand a considerable amount of abuse without being rendered inoperative.

A further object of the present invention is the provision of a meter lock using a sheet metal band in which access to an edge of the band for the purpose of cutting is rendered difficult.

It is another object of the instant invention to provide a meter lock which is inexpensive to manufacture and which is capable of a long life of useful services with a minimum of maintenance.

A still further object of the invention is the provision of a meter lock which is provided with an unlocking key and in which the key hole is incapable of being jammed.

It is a still further object of the invention to provide a meter lock which is capable of being provided with a seal to show the presence of tampering, but in which the removal of the seal does not render the opening of the lock substantially easier by an unauthorized person.

It is a still further object of the present invention to provide a meter lock which, from the nature of its design, is capable of being constructed of a small number of very strong, simple, and rugged parts.

Another object of the invention is the provision of a meter lock consisting of a small number of readily-replaceable elements.

Another object of the invention is the provision of a meter lock which may be sealed prior to installation, wherein the seal is in full view at all times, which is easy to install, in which installation does not require a key (so that a minimum number of keys are in circulation).

SUMMARY OF THE INVENTION

In general, the invention consists of a meter clamp having a band in the form of a loop which is adapted to embrace an annular meter flange. A housing is permanently attached to one end of the band and the housing is provided with an inner chamber and with a passage leading to it. The other end of the band is formed with an apertured tongue which is adapted to extend into the passage. A cam member resides in the chamber and has a finger extending into the passage for engagement with the aperture in the tongue, the cam member being spring-biased in the direction of the passage. A lock pin extends through the housing and through the chamber, the pin engaging the cam member and preventing the retraction of the finger from the aperture in the band. Means is provided for preventing the lock pin from being removed from the housing to release the finger.

More specifically, the lock pin is formed with a groove and a leaf spring normally resides in that groove and prevents removal of the pin from the housing. The latching means consists of a sheet metal spring member which lies in the chamber with a rear portion lying against a rear wall surface of the chamber and with side portions lying against side wall surfaces of the chamber. The locking pin is provided with two annular grooves each lying in the plane of one of the side members of the spring member. Each of the side members is notched to divide it into two resilient fingers which reside in the grooves. The locking pin has an axial bore and has passages which extend radially from the bore to the root of each groove. An unlocking key is provided having a central shaft which fits in bore in the locking pin and radial pins which are adapted to lie in the passages. The pins are extendable through the passages to release the fingers of the spring member from the grooves to permit removal of the locking pin.

DESCRIPTION OF THE PREFERRED EMBODIMENT

Figure 1:
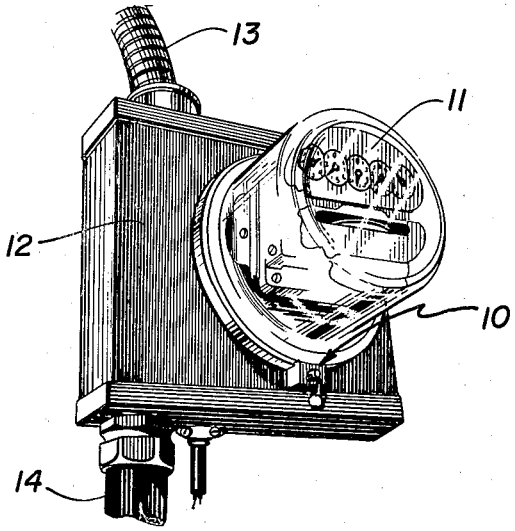
FIG. 1 is a perspective view of a meter lock incorporating the principles of the present invention, shown in use with a conventional meter and a meter box.

Referring first to FIG. 1, wherein are best shown the general features of the invention, the meter lock, indicated generally by the reference numeral 10, is shown in use with a conventional meter 11 and the usual meter box 12. The meter box is mounted on the side of a building; a cable 13 leads downwardly from the weather head and enters the upper part of the box. An outlet cable 14 leads from the bottom of the box to the main switch in the interior of the building and to the fuse box serving the building.

Figure 2:
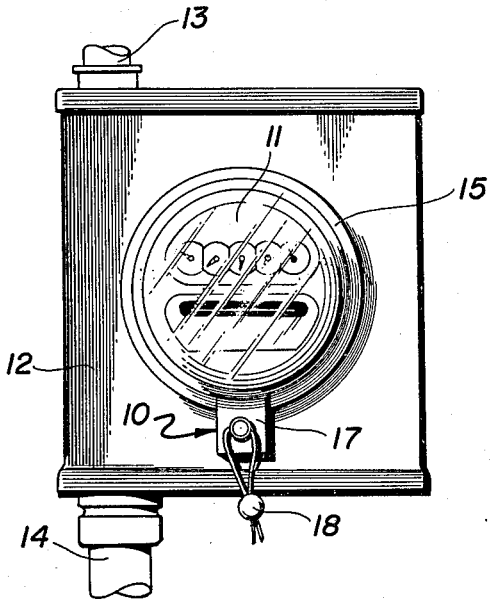
FIG. 2 is a front elevational view of the meter lock.
Figure 3:
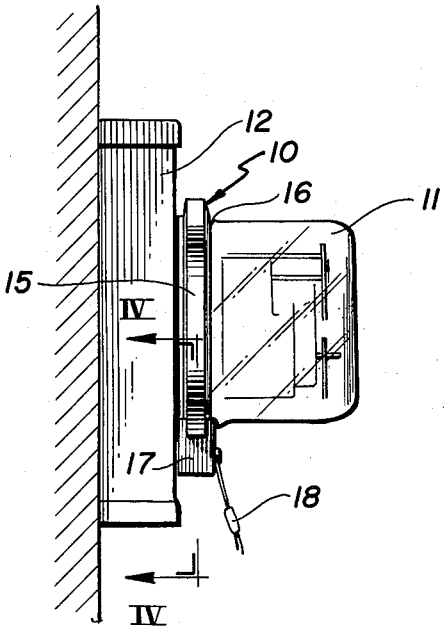
FIG. 3 is a side elevational view of the meter lock.

FIGS. 2 and 3 show the general arrangement of the meter lock 10 on the meter 11 and the meter box 12. The meter generally consists of a glass or clear plastic housing having a flange 16 of annular form which lies beside a similar flange formed on the meter box. A band 15 of U-shaped cross-section embraces the two flanges and forms part of the meter lock. The ends of the band enter a housing 17 on which is carried a seal 18.

Figure 4:
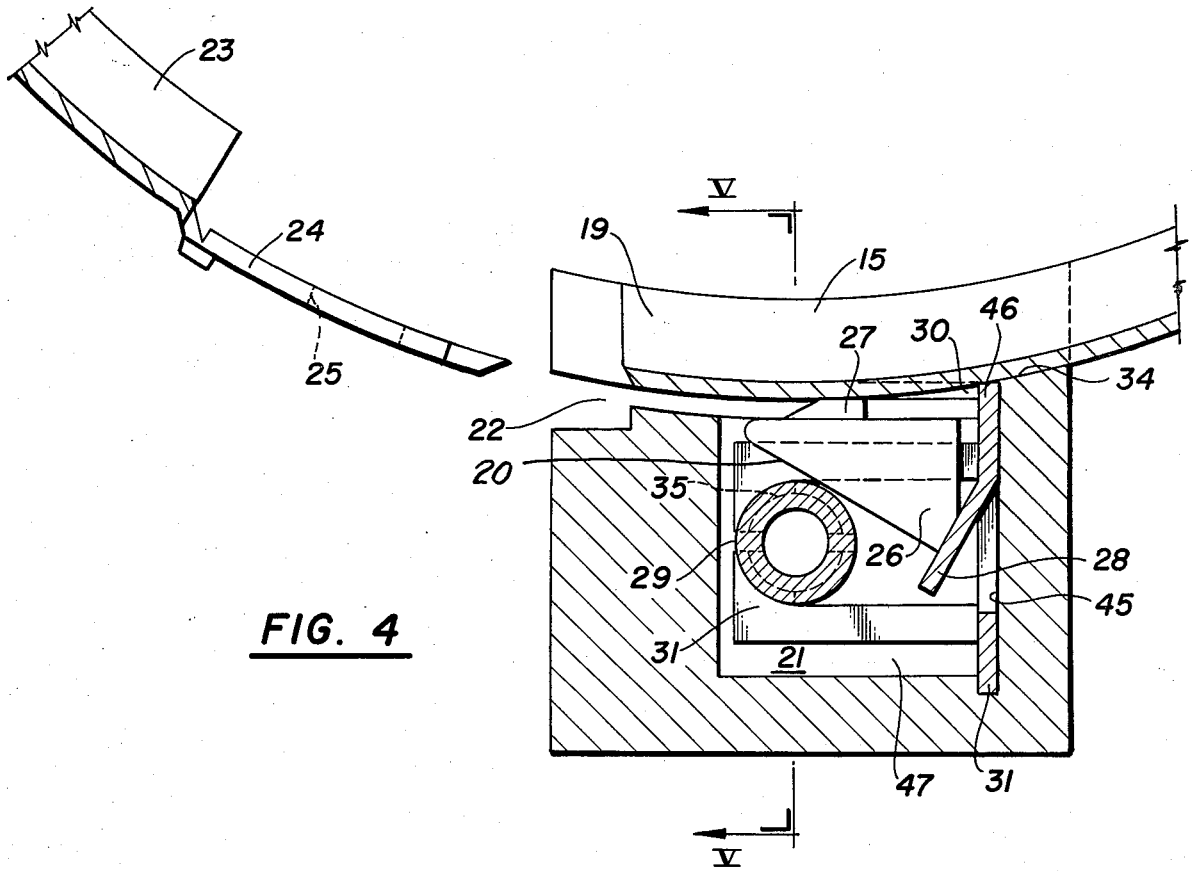
FIG. 4 is a sectional view of the meter lock taken on the line IV—IV of FIG. 3.
Figure 5:
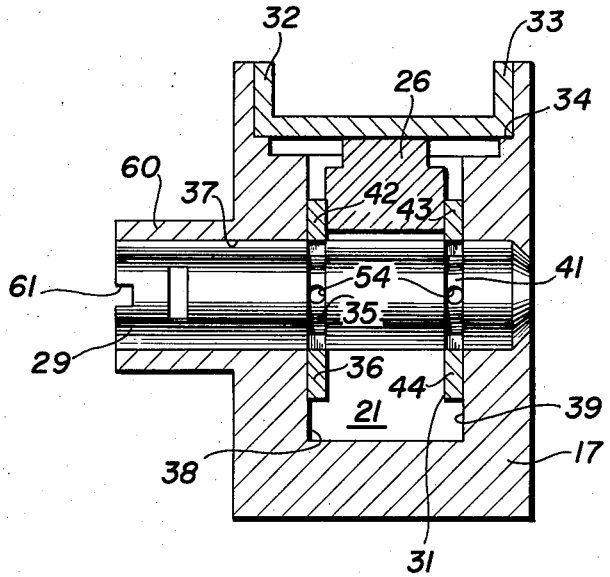
FIG. 5 is a vertical sectional view of the meter lock taken on the line V—V of FIG. 4.

In FIGS. 4 and 5 it can be seen that the band 15 has one end 19 apparently attached to the housing 17 by welding or the like. The housing is formed with an inner chamber 21 and with a passage 22 leading into it. The other end 23 of the band 15 is provided with a tongue 24 having an aperture 25. This tongue is adapted to be introduced into the passage 22 and an abutment on the tongue resides in a recess on the housing to inhibit unauthorized entry into the housing. A cam member 26 resides in the chamber 21 of the housing and has a finger 27 which extends into the passage 22 for engagement with the aperture 25 in the tongue 24. A leaf spring 28 biases the cam member 26 toward the passage 22 and, in the preferred embodiment, presses the finger 27 against the outer surface of the end 19 of the band 15. A lock pin 29 extends through the housing 17 with its axis perpendicular to the general plane of the band 15. The pin extends through the chamber and its outer cylindrical surface engages an inclined surface 20 on the wedge shaped cam member 26 and prevents the retraction of the finger from the aperture 25 when the two are engaged. A latching means 31 prevents the lock pin 29 from being axially removed to release the finger 27 from the aperture.

As is evident FIG. 5, the band has a U-shaped cross-section with the legs 32 and 33 directed inwardly of the loop and the housing 17 is provided with an arcuate recess 34 to receive the said one end 19 of the band. The recess is formed closely to embrace the outer surfaces of the band and, as has been stated, the two are welded together. A tongue 30 is lanced out of the band for engagement with rear portion 46 of the spring member 31.

The lock pin 29 is provided with a first groove 35; a leaf spring 36, forming part of the latch means 31, resides in the groove and prevents removal of the pin 29 from the housing. A bore 37 extends through the housing 17 and the pin 29 resides in the bore with its axis perpendicular to the plane of the loop of the band. The chamber 21 has two spaced, parallel, inner wall surfaces 38 and 39. The lock pin is provided not only with the groove 35 which resides adjacent the wall surface 38, but also which a second groove 41 which resides adjacent the wall surface 39. A leaf spring 36 lies against the wall surface 38 and, of course, engages the root of the groove 35 on the pin, while a similar spring 44 resides adjacent the wall surface 39 and resides in the groove 41. Similarly, springs 42 and 43 lie adjacent the wall surface 38 and 39, respectively, and also engage the grooves 35 and 41. The spring member 31 is held in place with the rear portion 46 against the chamber surface 45, because the lower edge of the rear portion lies in a groove at the bottom corner of the chambers and the upper edge is locked behind the edge of the tongue 30 punched from the band 15.

The spaced, parallel, side wall surface 38 and 39 of the chamber 21 extend parallel to the plane of the loop of the band 15 and the chamber is also provided with a rear wall surface 45 (see FIG. 4) which extends at a right angle to the side wall surfaces. A sheet metal spring member lies in the chamber with a rear portion 46 which lies against the rear wall surface 45 and with side portions 47 and 48 to lie against the side wall surfaces 39 and 38, respectively. The lock pin 29, of course, extends perpendicular to the side wall surfaces and the grooves 35 and 41 lie in the plane of the side portions 47 and 48 of the spring member. As is particularly evident in FIG. 9, the side portions 47 and 48 are provided with notches 49 and 51, respectively, which embrace the root of the grooves 41 and 35, respectively. The root of each pin groove 35 and 41 is cylindrical and the notches 49 and 51 of the side portions 47 and 48 divide their respective side portions of the spring member into two relatively flexible fingers. The side portions 47 and 43 include the two relatively flexible fingers 36 and 42 and 43 and 44. Each finger has an inwardly-extending pad portion with an accuate edge 52 which normally lies against the cylindrical root surface of the groove.

Figure 7:
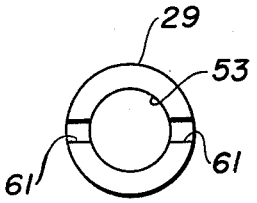
FIG. 7 is a left hand end elevational view of the locking pin.
Figure 6:
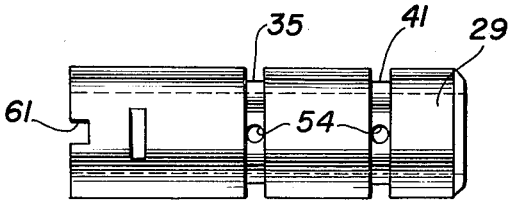
FIG. 6 is a front elevational view of a locking pin forming part of the invention.
Figure 8:
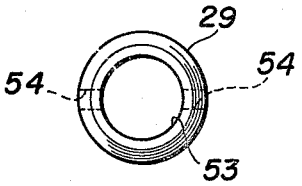
FIG. 8 is a right hand end elevational view of the locking pin.

FIGS. 6, 7, and 8 show the details of the locking pin 29 and show that it has an axial bore 53 with radial passages 54 which extend outwardly from the bore to the root of each of the grooves 35 and 41. Notches 61 are provided at the outer end of the pin where it extends a short distance from the housing 17 and a sealing passage 50 extends entirely through the pin and is matched by a similar set of apertures in the flange 60 to receive the seal 18.

Figure 9:
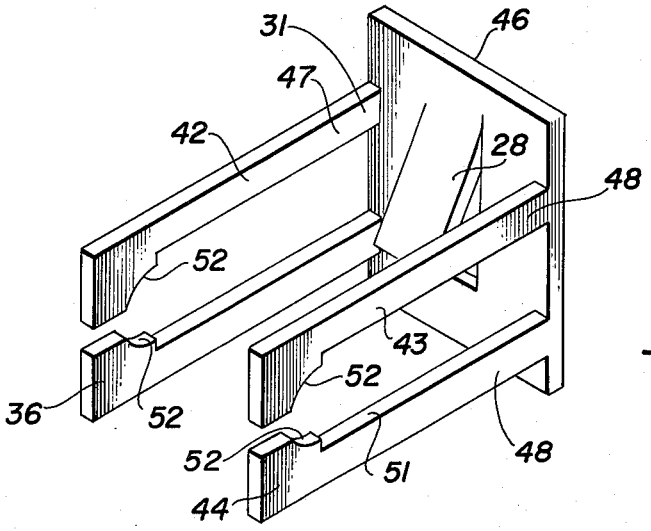
FIG. 9 is a perspective view of a spring member forming part of the invention.

FIG. 9 shows the details of the latching means 31 and clearly shows the rear wall 46 and the side walls 47 and 48. In addition, it shows the manner in which the notches 49 and 51 divide the side portions 47 and 48 into resilient fingers 36, 42, 43, and 44, while the leaf spring 28 is punched from the rear wall.

Figure 10:
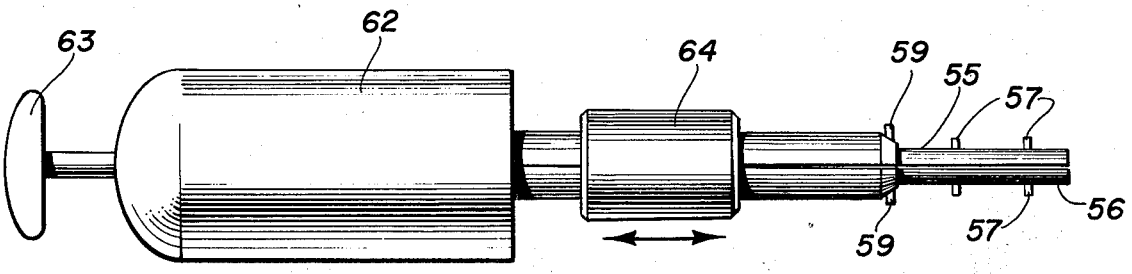
FIG. 10 is a front elevational view of an unlocking tool forming part of the invention.
Figure 11:
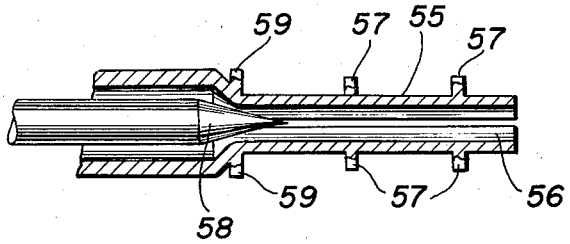
FIG. 11 is an enlarged sectional view of a portion of the unlocking tool.
Figure 12:
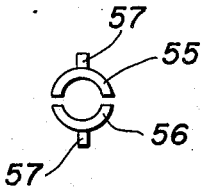
FIG. 12 is an end elevational view of the tool.

FIGS. 10, 11, and 12 show the details of the unlocking key 55. This is shown as having a split central shaft 56 which fits loosely into the bore 53 in the locking pin. The shaft is provided with radially-extending pins 57 adapted to lie in the passages 54 in the locking pin. The shaft 56 is split and the interior is provided with conical surfaces which are engaged by a wedge 58. The wedge serves to expand the split shaft and to cause the pins 57 to move outwardly into the passages 54. When this is done, and the locking pin is suitably rotated, each pin pushes its corresponding spring member 36, 42, 43 and 44 entirely out of the locking pin groove, so that the locking pin can be withdrawn axially from the housing. The cam member 26 is then able to move into the chamber, thus withdrawing the finger from the aperture in the tongue. As is clearly evident in FIG. 4, the arcuate edges 52 of the pad portions of the spring members 36, 42, 43, and 44 contact the locking pin grooves 35 and 41 on generally diametrically opposite sides thereof and the passages 54 also extend in diametrically opposite directions. The unlocking key has another pair of radial pins 59 which engage the notches 61 on the outer end of the locking pin 29, the relationship of these last named pins in notches being such that, when they are engaged in the notch 61, the radial pins 57 are lined up with the passages 54 in the locking pin.

The operation and the advantages of the present invention will now be readily understood in view of the above description. When it is desired to assemble the meter and the meter box, a power company employee places the flange 16 of the meter 11 against the corresponding flange on the front face of the meter box 12. This, of course, is after all the wiring associated with the cables 13 and 14 has been completed. With the two flanges in juxtaposition, the band 15 is placed around the flanges with the end 19 carrying the housing 17 in the lower "6 o'clock" position. The band is tighted around the flanges and the tongue 24 is introduced into the passage 22 and into the side of the housing. The tongue advances along the passage until it encounters a slight incline on the facing surface of the finger 27 forming part of the cam member 26. The advancing end of the tongue 24 is also formed with an incline to slide together with the finger 27 thus forcing the finger and the cam member downwardly against the pressure of the spring 28. Eventually, the tongue slides between the finger 27 and the surface of the band 15 and advances along the passage until the aperture 25 arrives; at that time the finger 27 slides into the aperture and again advances upwardly into contact with the surface of the band 15.

In that position, the square forward surface of the aperture 25 engages the square (or radial) rear surface of the finger 27 and it is then impossible to remove the tongue 24. Any attempt to do so will cause the cam member 26 to ride even further up of the surface of the locking pin 29 (due to the engagement with the pin 29) and to make the locking situation even tighter. If a vandal or thief wishes to gain access to the locking mechanism, no edge of the band 15 is exposed for him to use in cutting the band, since both ends lie within the housing 17. There is no passage for the unauthorized person to use to introduce a tool, since the tongue 24 and the band 23 entirely occupy the passage 22 and the arcuate recess 34 in which the two end parts of the band lie. Also, the protuberance and recess cooperate to produce the same effect. The exposed end of the pin 29 is of no assistance to the vandal since the bore 53 simply extends through the pin. The surface of the pin sliding in the bore 37 in the housing offers no access opening even with fairly powerful burglar tools. In the preferred embodiment, furthermore, an annular flange 60 (FIG. 5) extends from the housing 17 and totally surrounds the protruding end of the locking pin except for sealing apertures matching the passage 50 on the pin. Attempting to pull the outside of the pin simple presses the resilient fingers 36 and 42 against the forward inner surface 38 of the chamber 21 and the only way that it can be pulled out is by shearing the material in these fingers which would require tremendous forces, particularly in view of the fact that the pin leaves very little protrusion for gripping by a pulling tool. In the reverse direction, a hammer striking the pin would have to shear the resilient fingers 43 and 44 against the rear wall 39 and the strength of sheet metal in shear is very great. Also, the non-protruding end of the locking pin seats in a conical end of the bore 37. It is, therefore, almost impossible to gain access to the lock or to cut the band, particularly when its simple construction permits it to be made from very strong material. As a matter of fact, any attempt to open the lock by force will cause it to lock even tighter. The rear portion 46 of the spring member 31 extends upwardly adjacent the right side of the passage 22 to inhibit access in that direction.

If an electric company employee wishes to open the meter clamp to remove the meter and so on, it is only necessary to use the special unlocking key 55. When this is inserted and the pins 59 lie in the notches 61, the pins 57 will be aligned with their corresponding passages 54 in the locking pin. The operation of the handle 63 causes the wedge 58 to force the split parts of the shaft 56 apart, thus causing the pins 57 to advance radially through the passages 54.

Eventually, the pins 57 emerge from the passages 54 into the root of the grooves 35 and 41; they then serve (when the locking pin is rotated) to push the fingers 36, 42, 43, and 44 out of the grooves. When the fingers are entirely out of the grooves, it is possible to pull on the locking key and the locking pin will move out of the bore 36 and out of the housing. When this is done, the cam member falls downwardly and the finger 27 leaves the aperture 25 in the tongue 24, so that it is possible to pull the end 23 of the band 15 out of the passage 22 and the meter is free to be removed. In order to remove the unlocking key 55 from the lock pin 29, one grasps the handle 62 and pulls the hand grip 63, thus removing the wedge 58 from its position and allowing the halves of the split shaft 56 to move together. In order to assure that they move together, a sleeve 64 is slidably mounted on the upper part of the shaft; when the sleeve 64 is moved away from the handle 62, it serves to pull the two halves of the split shaft tightly together. This withdraws the pins 57 entirely from the passages 54 and it is possible to remove the unlocking key from the bore 53 and the locking pin.

It can be seen, then, that the present device is not only simple and rugged, but it consists of a few simple parts which are easily replaced if damaged. The passage 50 and the corresponding passage in the flange 60 on the housing 17 allow the flexible seal 18 to be used to give an indication of whether an attempt to tamper with the lock has been made.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed new and desired to secure by Letters Patent is:

1. Meter clamp, comprising:
(a) a band formed as a loop adapted to embrace an annular meter flange,
(b) a housing permanently attached to one end of the band, the housing being formed with an inner chamber and with a passage leading into it and the other end of the band being formed with an apertured tongue adapted to extend into the passage,
(c) a cam member residing in the chamber and having a finger extending into the passage for engagement with the aperture in the tongue, said cam member having a cam surface,
(d) a spring biasing the cam member toward the passage,
(e) a removable lock pin lying in the housing and through the chamber, the lock pin engaging said cam surface and preventing retraction of the finger from the aperture, and
(f) latching means preventing the lock pin from being removed to release the finger.

2. Meter clamp as recited in claim 1, wherein the band has a U-shaped cross-section with the legs directed inwardly of the loop, and wherein the housing is formed with an arcuate recess to receive the said one end of the band.

3. Meter clamp as recited in claim 1, wherein the lock pin is formed with a groove, and wherein a leaf spring normally resides in the groove and prevents removal of the pin from the housing.

4. Meter clamp as recited in claim 1, wherein a bore extends through the housing and the lock pin resides in the bore with its axis perpendicular to the plane of the loop, wherein the chamber has two spaced, parallel inner wall surfaces, wherein the lock pin has an annular groove formed adjacent each of the said wall surfaces, and wherein a leaf spring resides adjacent each wall surface for engagement with the corresponding groove in the lock pin.

5. Meter clamp as recited in claim 1, wherein the chamber has two spaced, parallel side wall surfaces extending parallel to the plane of the loop and a rear wall surface at a right angle to the side wall surfaces, and wherein a sheet metal spring member lies in the chamber with a rear portion lying against the rear wall surface and with side portions lying against the side wall surfaces, the rear portion having its lower end lying in a groove at the bottom of the chamber and its upper end engaging a tongue punched from the band.

6. Meter clamp as recited in claim 5, wherein the lock pin extends perpendicular to the side wall surfaces, and wherein the lock pin is provided with a groove adjacent to each side portion of the spring member, each side portion being provided with a notch which embraces the root of its groove.

7. Meter clamp as recited in claim 6, wherein the root of each lock pin groove is cylindrical, and wherein each notch divides its side portion of the spring member into two relatively flexible fingers, each finger having an inwardly-extending pad portion with an arcuate edge that normally lies against the cylindrical root of the groove.

8. Meter clamp as recited in claim 6, wherein the lock pin has an axial bore and radial passages extending from the bore to the root of each groove, wherein an unlocking key is provided having a central shaft fitting in the bore in the lock pin and radial pins adapted to lie in passages, the unlocking key having a wedge to press the radial pins radially outwardly, so that each radial pin extends outwardly of its passage and pushes the corresponding spring member finger entirely out of the lock pin groove, whereupon the lock pin can be withdrawn axially from the housing and the cam member moves into the chamber, withdrawing the finger from the aperture in the tongue.

9. Meter clamp as recited in claim 8, wherein the arcuate edges of the pad portions of the spring members contact the lock pin groove on generally diametrically opposite sides thereof, and wherein each pair of passages extends in diametrically opposite directions.

10. Meter clamp as recited in claim 9, wherein the unlocking key has another pair of radial pins that engage notches on the outer end of the lock pin, the relationship of these last-named radial pins and notches being such that, when they are engaged, the first-named radial pins are alligned with their corresponding passages in the lock pin.

11. Meter clamp, comprising:
(a) a band formed as a loop adapted to embrace an annular meter flange,
(b) a housing permanently attached to one end of the band, the housing being formed with an inner chamber and with a passage leading into it, the other end of the band being formed with an apertured tongue adapted to extend into the passage,
(c) a cam member located in the housing and forming a separate movable element within the housing, said cam member having a finger which is spring-biased to a position within the passage for engagement with the aperture in the tongue into the passageway and to prevent withdrawal of the tongue from the passage by virtue of the engagement of the finger within said aperture, and
(d) locking means for engaging said cam member at a point spaced from said finger and limiting movement of the cam member.

12. Meter clamp, comprising:
(a) a U-section loop band adapted to embrace an annular meter flange and similar flange on a meter box, the band having two free ends, one of the free ends having an aperture,
(b) retaining means including a projecting element that extends into said aperture for holding the free ends of the loop together to form a closed loop,
(c) a housing for shielding the retaining means, and
(d) locking means connected to the retaining means, said locking means comprising a key actuated locking pin that extends through the housing, the axis of the locking pin being transverse to the plane of the loop band.

13. Meter clamp as recited in claim 12, wherein the housing is provided with a circular flange that extends outwardly from the housing and circumscribes the locking pin.

14. Meter clamp as recited in claim 13, wherein the circular flange is provided with a pair of diametrically-opposed apertures for receiving a seal.

* * * * *